United States Patent [19]

Fernando

[11] Patent Number: 4,915,542

[45] Date of Patent: Apr. 10, 1990

[54] PROCESS FOR WATERPROOFING SURFACES

[76] Inventor: Gordun B. Fernando, Trinxan 63, Barcelona, Spain

[21] Appl. No.: 150,787

[22] Filed: Jan. 29, 1988

Related U.S. Application Data

[63] Continuation-in-part of Ser. No. 946,556, Dec. 24, 1986, abandoned, which is a continuation-in-part of Ser. No. 797,160, Nov. 12, 1985, abandoned.

[30] Foreign Application Priority Data

Nov. 16, 1984 [ES] Spain ..... 537709

[51] Int. Cl.[4] ..... E21D 11/00

[52] U.S. Cl. ..... 405/150; 405/132; 405/151

[58] Field of Search ..... 405/150, 151, 146, 288, 405/53, 55, 152, 153, 270; 52/169.14, 169.5

[56] References Cited

U.S. PATENT DOCUMENTS

| | | | |
|---|---|---|---|
| 4,052,860 | 10/1977 | Allerman | 405/259 |
| 4,379,654 | 4/1983 | Rovelli | 405/150 X |
| 4,463,529 | 8/1984 | Singer et al. | 52/169.14 X |
| 4,466,758 | 8/1984 | Hinterreiter et al. | 405/150 |
| 4,476,660 | 10/1984 | Francovitch | 405/259 X |
| 4,610,120 | 9/1986 | Canavesi et al. | 405/150 |
| 4,637,754 | 1/1987 | Wood | 405/150 |
| 4,695,188 | 9/1987 | Pulkkinen | 405/150 |

FOREIGN PATENT DOCUMENTS

| | | | |
|---|---|---|---|
| 81686 | 6/1983 | European Pat. Off. | 405/150 |
| 1029773 | 5/1958 | Fed. Rep. of Germany | 405/150 |
| 1914174 | 10/1970 | Fed. Rep. of Germany | 405/151 |
| 2607604 | 9/1977 | Fed. Rep. of Germany | 405/150 |
| 2941684 | 4/1981 | Fed. Rep. of Germany | 405/150 |
| 3206382 | 9/1983 | Fed. Rep. of Germany | 405/150 |
| 1438325 | 8/1968 | France | 405/150 |
| 1071758 | 2/1984 | U.S.S.R. | 405/150 |
| 2076040 | 11/1981 | United Kingdom | 405/132 |

*Primary Examiner*—Dennis L. Taylor
*Attorney, Agent, or Firm*—Ladas & Parry

[57] ABSTRACT

A method of waterproofing inner surfaces of tunnels, channels and mine galleries in which sheets of material are unrolled and cut in situ and applied to the surfaces of the wall to obtain the desired fit and so that the sheets are overlapped. Holes are cut into the walls through the sheets and anchors are attached to the walls. The anchors applied where the sheets overlap are on top of one of the sheets and are covered by another sheets. The overlapping regions are welded by thermal fusion. The anchors in the intermediate zones (where the sheets do not overlap) are covered with a circular part made from the same material as the sheets and more than 6 cm. greater than the diameter of the anchor heads. The anchors are applied in a greater density at the starting and ending zones and a sealing bead is applied between the sheets and the wall surface. In regions in which elements protrude from wall surface, the elements are protected by a washer made of the same material as the sheets and welded to the sheet by thermal fusion to form a zone around the element which is sealed by a thermally hardenable or vulcanizable sealing material.

8 Claims, 8 Drawing Sheets

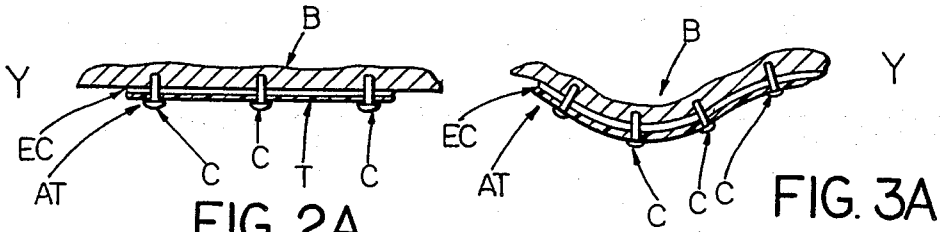
FIG. 2A
FIG. 3A
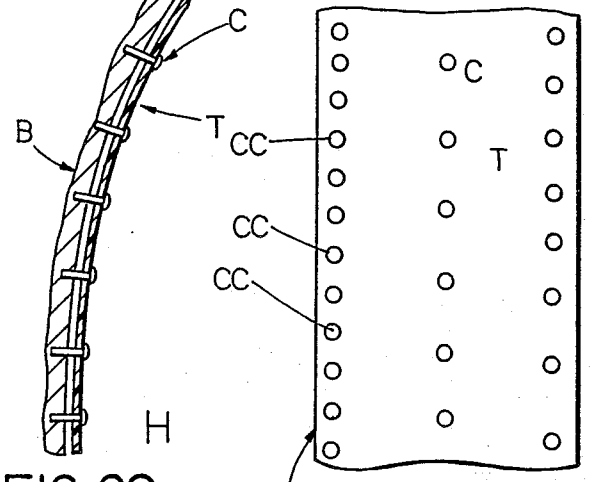
FIG. 2B
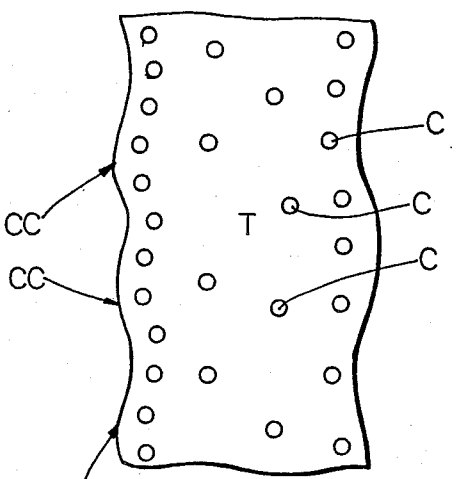
FIG. 3B
FIG. 2C
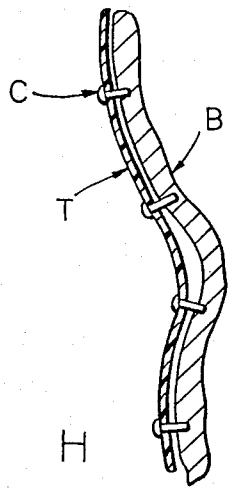
FIG. 3C

PROCESS FOR WATERPROOFING SURFACES

CROSS REFERENCE TO RELATED APPLICATIONS

This application is a continuation-in-part of application Ser. No. 946,556, filed Dec. 24, 1986, now abandoned, which in turn is a continuation-in-part of application Ser. No. 797,160, filed Nov. 12, 1985, now abandoned.

The present invention refers to a method of waterproofing surfaces and, in particular, of water-proofing the inner surfaces of tunnels, channels and mine galleries.

These surfaces are for the most part excavated with dynamite, in which case extensive transverse and longitudinal deformations are necessarily produced with a modulation of relief which in most cases is between 0.5 and 1 meters, resulting in very irregular surfaces. In other, less frequent cases, the surfaces are formed by stonework or vaults of concrete, leaving almost uniform and smooth surfaces.

The ambient within these tunnels, channels and galleries is extremely hostile, with strong infiltrations and runoffs of water, as well as air drafts and turbulences of great magnitude.

The inside temperatures are very low, rarely reaching 5° C. and almost always less than 0° C. Furthermore, the pressures are high.

It is obvious that it is not permissible to allow water to flow into the enclosures defined by the surfaces in question and that the water must be retained in the rock and suitably evacuated.

In order to achieve this, consideration has been given to covering these surfaces with cements, mortars, resins or rubbers, which are applied discontinuously, generally by manual means which are time consuming and costly, and are left to solidify and harden on said surfaces.

This solidification and the resultant hardening are effected by curing, vulcanization, hardening, etc.

Materials have been proposed such as Portland cement, special cements, epoxy resins, polyesters, polyurethanes, elastomeric rubbers, etc., but the great pressures, the intense flows of water and the low temperatures make the fastening, solidification and hardening thereof impossible. As a result, the desired waterproofing is not obtained.

Another solution to the problem which has been suggested consisted of intercepting the large waterways by drainage on basis of perforated pipes embedded in the vaults, fastening a layer of felt to the rock and subsequently spraying on two coats of elastomeric rubber which are vulcanized in situ. However, the filter becomes saturated with moisture and water of very low temperature. This prevents the vulcanizing of the layers of elastomeric rubber. Furthermore, considerable discharge of water take place through the places of attachment to the rock and of overlap of the layers. Therefore, this system does not give the desired result either.

Waterproofing has also been attempted by the overlapping sheets of polyvinyl chloride (known as PVC), sheets of synthetic rubber (for instance butyl rubber, neoprene rubber), sheets of asphaltic materials protected with aluminum, etc. by means of fastening systems or adhesives, but the results obtained have been very poor.

In the particular case of sheets of PVC fastened by an adhesive, the presence of water prevents proper hardening of the adhesive; forming bubbles, pores and blisters which, to a great extent, destroys the waterproofing.

In all these cases, the water emerges abundantly through the places of attachment to the rock and at the overlaps.

The slight thickness and poor malleability of such sheets give rise to a harmful negative cushioning due to the vibrations which necessarily are produced by the existence of air turbulences in the tunnels, channels and galleries.

Another known method of waterproofing consists in applying preformed mini-undulated sheets of high-density polyethylene (known as HDPE) and fastening them by various systems of pins, but it has not been possible to obtain total tightness in this way either.

Vaults and sides of reinforced concrete have also been used, at times as additional waterproofing and esthetic covering and at other times as vaults with load-bearing capacity. However, when rock and earth of poor resistance appear in this process, the expense becomes very high so that the solution becomes infeasible. Instead of this, reinforcement systems having a base of pins or bolts and charges of self-hardening resin, supplemented by visible waterproofing are used. This also results in very high costs.

German Unexamined Application for Patent No. OS 1914174 of Schildkröt AG discloses the sealing of a tunnel or gallery with continuous sheets coming from rolls of synthetic or plastic material. Strips of thermoplastic synthetic material are first fastened mechanically to the walls of the tunnel or gallery perpendicular to the length of the tunnel or gallery at certain distances apart. Continuous sheets are then placed over said strips and then attached to them in such a manner that the continuous sheets overlap approximately 2 cm; whereupon these sheets are welded together continuously.

The welding of the surfaces of the sheets to the strips is effected only between the places of attachment of the strips, whereby a free space without any attachment is left. By this process, however, in the case of surfaces excavated by dynamite to which my invention primarily and mainly applies, such surfaces, and with them the fastened strips which will adapt themselves to the deformations, can never come into alignment with the sheets which are to be welded to them. It is impossible to produce this welding in the presence of the large runoffs. Finally, in the large free spaces without attachment, the humidity of the rock support condenses, thereby increasing the runoff, as the present inventor has been able to verify. The system of that patent only gives good results in the case of smooth, dry surfaces without moisture or water, that is to say under conditions which are completely opposite to those which are present in the case of my invention.

On the other hand, careful application of the strips and the subsequent placing of the sheets followed by welding require a complicated and expensive multiphase process which it is impossible to carry out where there are large deformations.

In the unattached places, the air turbulences produced would be transmitted to the sheet as strong vibrations, destroying it at the places of anchorage and the covering crumbling away.

Also known is German Unexamined Application for Patent No. OS 2607604 of Zeiss-Chemie GmbH which describes a method of restoring tunnels, particularly railway tunnels, in which a support film which is coated or impregnated with a duroplastic polymer (that is to say a thermosetting polymer) is mounted on the wall of the tunnel, leaving a free space. This film is impermeable to water and capable of reacting in order to harden, but is still unreacted. After mounting has been completed, this polymer is caused to harden, whereupon another hardenable synthetic material which is caused to harden is applied to the inner surface of the film, so that a hard surrounding layer is produced which surrounds (but does not touch) the wall of the tunnel. The attachment of the film, that is to say its mounting, is produced by cutting holes in the surface of the tunnel, placing anchoring bolts through the support into the wall and then, after the hardening of the materials, cutting off the heads of the bolts. Finally, after the production of the hard surrounding layer it is necessary to cut, at certain distances apart, a few vertical channels, thus creating expansion joints.

Under the conditions in which the object of the invention is carried out it is impossible to effect the hardening, and therefore the patent which has just been discussed is unworkable.

Furthermore, it requires the costly operations of cutting holes in the walls of the tunnel, bolting down the support film, maintaining a distance between it and the wall, as well as then cutting the bolts. There is also impossible the overlap between sheets by a polymer which, as has already been stated, cannot harden in the presence of water.

Finally, from U.S. Pat. No. 4,476,660 to Thomas F. Francovitch there is known a membrane anchoring system for opening a surface of a roof with a membrane or other waterproof material, anchored by linear fastening members which penetrate through it and are fastened to the structure of the roof which is located in the rear. A thin elastic body in the form of a disk made of metal is provided in order to apply said membrane, said elastic body being deformed in a tensioned state under the load imposed by the fastening element.

This body, made of an elastic metal, is of rather complicated structure (as can be better noted from the figures of said patent) and is therefore expensive.

Furthermore, it is necessary to place a mastic between the body and the membrane, with the consequent hardening problems.

Such an anchoring arrangement does not exert any waterproofing function, serving merely as a cover sealer for movements exerted below the head of the fastening element, with an effect only on very restricted and limited surfaces.

With a knowledge of all of this prior art, the inventor has desired to develop a new method of waterproofing which satisfies the following requirements:

An effective visible waterproofing of long life must be produced.

It must be possible to produce it even in the presence of large amounts of water.

The waterproofing must adapt itself to irregular surfaces with substantial reliefs of up to one meter.

It must be capable of being carried out easily and with simple tools and at very low cost.

It is to be applied to new work and to repair work.

In order to be able to satisfy these requirements it was necessary to develop a cover sheet having very strict and rigorous properties, while being at the same time of low cost since the materials used up to now have proven defective.

The specifications for this sheet are:

It must have a very low coefficient of thermal conductivity and a thickness such as to obtain thermal insulation which withstands sudden heat changes of 20° to 30° C., such as occur very frequently, particularly in cold climates.

It must be waterproof throughout.

It must be fireproof and meet French specification M-1 or German specification K-2, giving off non-toxic fumes in case of fire.

It must be resistant to aging by constant moisture and strong climate changes.

It must have a high resistance to tearing together with a high tensile strength.

It must be heat-sealable.

In order to understand these requirements, the conditions in which this sheet must develop its waterproofing function will now be set forth.

In railway and highway tunnels vibrations occur produced by the air turbulences generated upon the passage of trains or automotive vehicles, with very short distances of 0.4 m to 1.50 m between the walls and the train or vehicle.

The vibrations produced by the air turbulences, upon being transmitted to the sheet, reach a place of attachment, producing a cyclic vibration which widens the diameter of the perforation in the sheet and ends up by tearing it.

Particularly in road or highway tunnels, in addition to the said vibrations by turbulence there are the conditions generated by the blowers in two directions which are indispensable in order to eliminate the carbon monoxide coming from the exhaust pipes of the vehicles. In addition, there are the disturbances originating due to traffic accidents, traffic holdups, fire, etc.

Having discovered a sheet which satisfies these requirements, the present inventor found that it can be fastened to the rock by a few simple anchors of rustproof material located suitable distances apart which are adapted to the deformations of the surface to be waterproofed. When these anchors are located in the places of overlap, the anchor heads are protected by the overlapping upper sheet while, when the said anchors are located in intermediate zones between overlaps, their heads are protected by circular parts of the same heat-sealable material as the sheet and of a diameter 3 or 4 cm greater than said head.

The sheets extend over the walls directly from the rolls, are cut in place to the size necessary to obtain perfect adaptation to the surface to be waterproofed, providing a minimum overlap between contiguous sheets of about 10 cm in the longitudinal and transverse directions of the tunnel, channel or gallery. The anchors were previously fastened to the wall and pass through the sheet (the lower one in the event that the attachment is made at a place of overlap).

In this way, when water emerges from the rock it is channeled towards the ground between the sheets and the surface, and the heat-sealing of the overlapping parts of the sheets can be produced in almost completely dry state.

A waterproof bead of foamed material or rubberoid sealer is placed in the end cross sections of the covering lengths and the holes of the anchors adjacent the sheet are closed by an elastic sealing material which will be hardened under dry conditions.

The fastening of the anchors to the wall, passing through the sheet, is made by means of a rotary and percussion cutting tool. The anchor, of rust-proof material of high density, is an element with a circular head of suitable and sufficient diameter and slight height and with a grooved cylindrical body of a diameter somewhat greater than that of the drill hole produced, so that, when secured by percussion impact exerted on its head, it adapts itself perfectly in tight fashion to the walls of said hole. It can thus withstand high tension and substantial weight and be of very long life due to its material. Furthermore, its cost is low.

As already stated, the places of attachment of the anchors are closely fitted to the irregularities of the surface, thereby channeling the water along the inner face of the sheet to the floor of the tunnel, channel or gallery and at the same time greatly decreasing and cancelling out the vibrations caused by turbulences of air, to which reference has been made above.

Placing circular protective parts on the heads of the anchors which are not covered by sheets produces, as has been mentioned, the desired and necessary complete waterproofing. At the same time, the pathological tensions originating from producing the thermal fusion are counteracted and the thickness is thereby increased at the places of the thermal fusion.

In the transverse end parts, that is to say in the beginning of the first sheet and in the end of the last, a bead of foamed material is placed between the sheet and the surface. This satisfies the technical characteristics of being fireproof, resistant to tearing, of great longevity against permanent moisture and of not being deformable by extreme climatological changes. The bead has a width of at least 10 cm and a thickness of more than 1 cm. In place of the bead of foamed material a bead of sealing material can also be used which functions to close off the end against streams of air. After being vulcanized, it acquires a rubber consistency. The bead is not situated precisely on the transverse end parts but between them and the transverse axis of the adjacent line of anchoring elements of the fastening system. The foamed material is selected for wet surfaces and the sealer selected for dry surfaces.

Finally, in the zones of the surface from which elements are to protrude (parts or anchors) corresponding to blowers, light fixtures, carbon monoxide, temperature or hygrometry control sensors, etc. as well as conduits for cables, catenaries or other elements or apparatus which may be necessary in particular in tunnels for road traffic, a circular protective part in the manner of a washer which consists of the same material as the sheet is applied and thermally fused around each of said protruding elements. It is applied in a manner that said protective part adapts itself precisely to the protruding element and has a diameter more than 6 cm greater than the diameter of such element.

This protective part is closed over its entire outer surface with a material which is compatible with and adapted to the material of the protruding element (this last-mentioned material may be aluminum, plastic, iron, etc.).

Having defined the invention sufficiently above, a preferred embodiment will be described below applied to tunnels intended for highway traffic, with reference to the accompanying drawings in which:

FIGS. 1A, 1B and 1C are a cross section, a side view and a plan view, respectively of a tunnel which has been waterproofed by the process of the invention.

FIGS. 2A, 2B and 2C are diagrammatic views of the waterproofing of a smooth, uniform surface, FIG. 2A showing a detail of a horizontal longitudinal placing; FIG. 2B is a detailed front view showing the distribution of the anchors in a beginning end of sheet and FIG. 2C is a detail of the vertical transverse placement. FIGS. 3A, 3B and 3C are, in a manner corresponding to FIGS. 2A, 2B and 2C, diagrammatic views of details of the waterproofing of more irregular surfaces having large deformations, FIG. 3A being a detail of the horizontal longitudinal placement; FIG. 3B is a detailed front view of the distribution of the anchors on a starting end of sheet, and FIG. 3C a detail of the vertical transverse location.

Figure 1A:
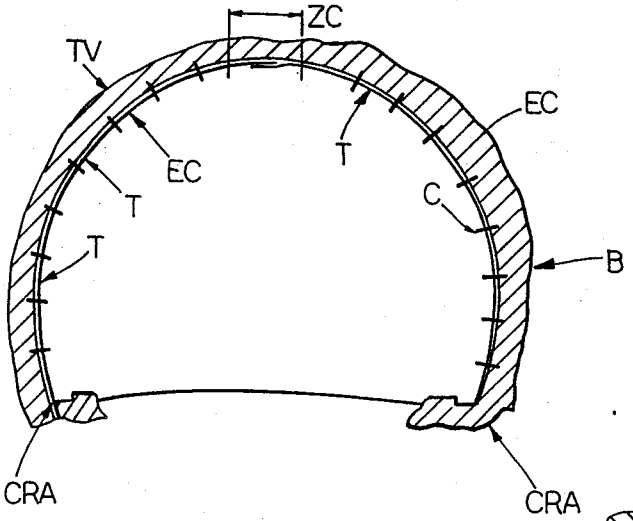
Figure 1B:
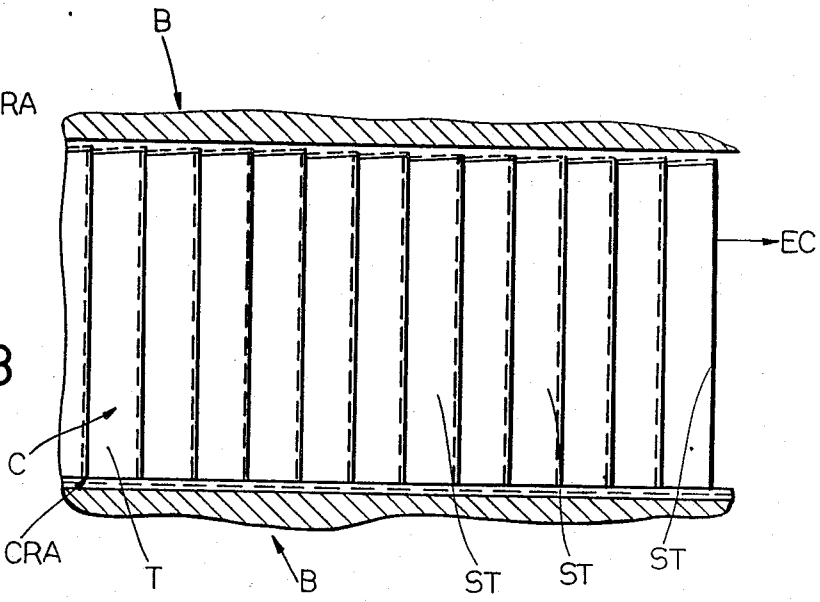
Figure 1C:
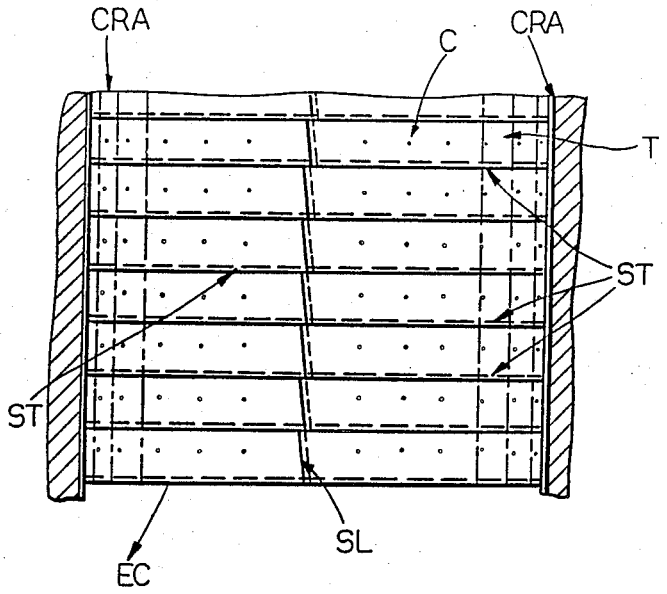

Referring first of all to FIGS. 1A, 1B and 1C, there can be noted in the transverse section (FIG. 1A) of the tunnel TV a surface B of rock which has been waterproofed by application of sheets T, strips of sheets (T) which overlap transversely and longitudinally being applied in the key zone (ZC) or zone of intersection of the axis of the tunnel with the vault, the transverse overlaps being indicated by ST and the longitudinal overlaps by SL. On both lateral sides of the floor there are water collection channels CRA. At the starting and ending ends of waterproofing strips there are located closing and sealing beads (EC). In FIG. 1A the places of fastening of anchors (C) are indicated by perpendicular lines.

In FIG. 1B various transverse overlaps can be noted in a view in elevation of a side wall of the tunnel. In this figure and in FIG. 1C the places of attachment of the anchors C are indicated by dots.

FIG. 1C is a plan view, seen from below, of the waterproofed surface B, and there can be noted the transverse overlaps ST on the side walls of the tunnel and the longitudinal overlaps SL present in the key zone ZC, which coincides with the vault.

Referring to FIGS. 2A–C and 3A–C diagrammatic detail views show the manner in which the sheet T is applied and fitted to the surface B by means of the attachment of anchors C which are deliberately and suitably fastened to the rock through the sheets T at suitable places for obtaining the best fit to the surface B. It can be noted in FIG. 2B, which refers to a smooth surface, that the anchors are arranged in straight, regular rows, with a greater density of anchors in the region of the beginning of the sheet AT.

On the other hand, in FIG. 3B, which concerns an irregular, deformed surface, the anchors are arranged at the places best suited to obtain the optimum fit, their distribution being therefore entirely irregular. Again the density of anchors C is greater in the region of the beginning of the sheet AT.

In FIGS. 2A and 3A, which correspond to the waterproofing of vaults, there can be noted, in the region of the beginning of the sheet (AT), the placing of a rubber closing or sealing bead (EC) made of foamed or sealing material, depending on whether the surface is in wet or dry state.

With this bead one succeeds in avoiding the penetration of air between the surface B and the sheet T, which penetration is dangerous for the integrity of the sheet due to the air drafts and strong turbulences which are inevitable in tunnels.

In FIGS. 2C and 3C which correspond to the waterproofing of side walls H there can again be noted the perfect fit of the sheet T to the surface B.

Figure 4B:
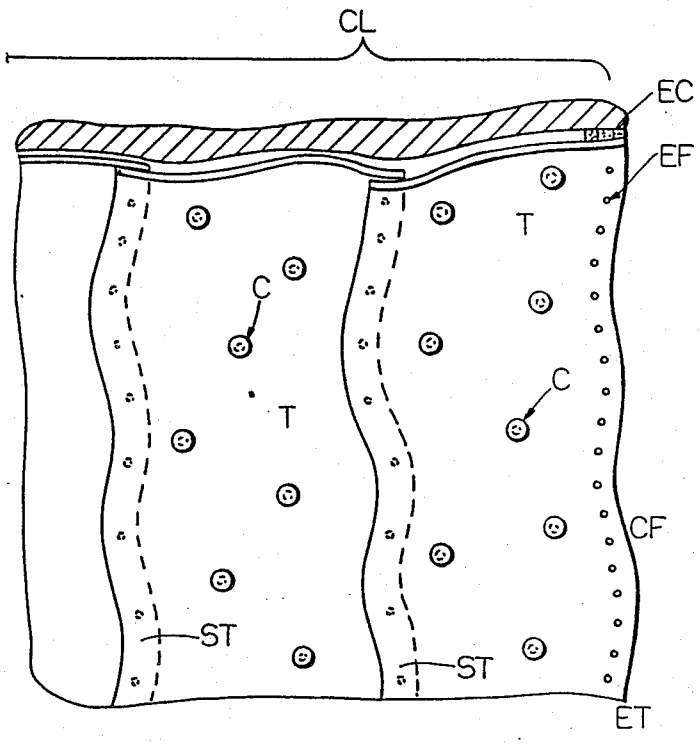
FIGS. 4A and 4B show diagrammatically details of the placing of the waterproofing sheets in the region of a waterproofing end, there being shown in FIG. 4A the case of a smooth, uniform surface and in FIG. 4B the case of a deformed, irregular surface.
Figure 4A:
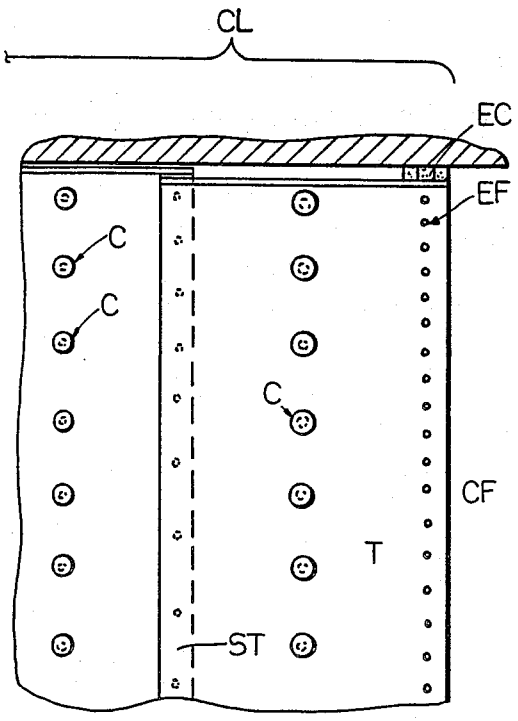

FIGS. 4A and 4B show the placing of waterproofing sheets T in a section of the tunnel to be waterproofed, which includes an end of a waterproofing zone CL. In this end zone there is noted a greater density of anchors which, for purposes of distinction, will be called CF.

This greater density of anchors is accompanied by a sealing bead of foamed or sealing material, thus reducing the penetration of air into the space between the sheets T and the surface B.

Figure 5:
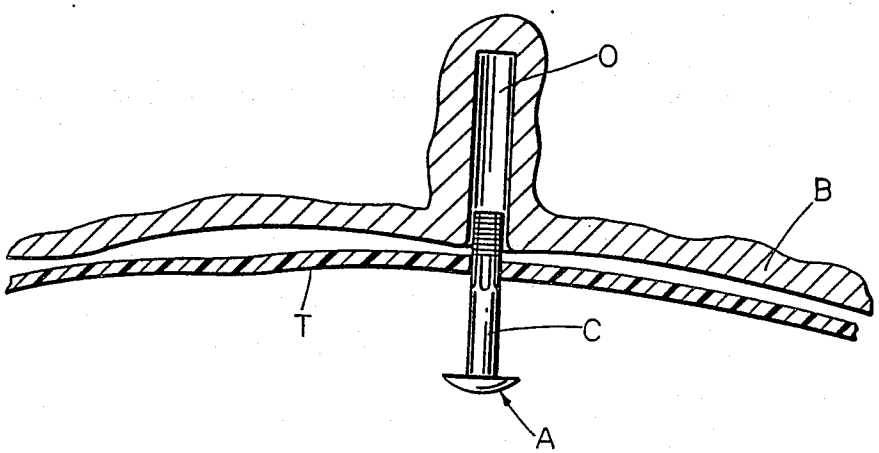
FIG. 5 shows diagrammatically the location of an anchor at a place, intermediate between overlaps, of the width of the sheet.

FIG. 5 shows the placing of an anchor C in an intermediate zone of the width of a sheet T, there being indicated the hole 0 drilled in the rock through the surface B.

Figure 6:
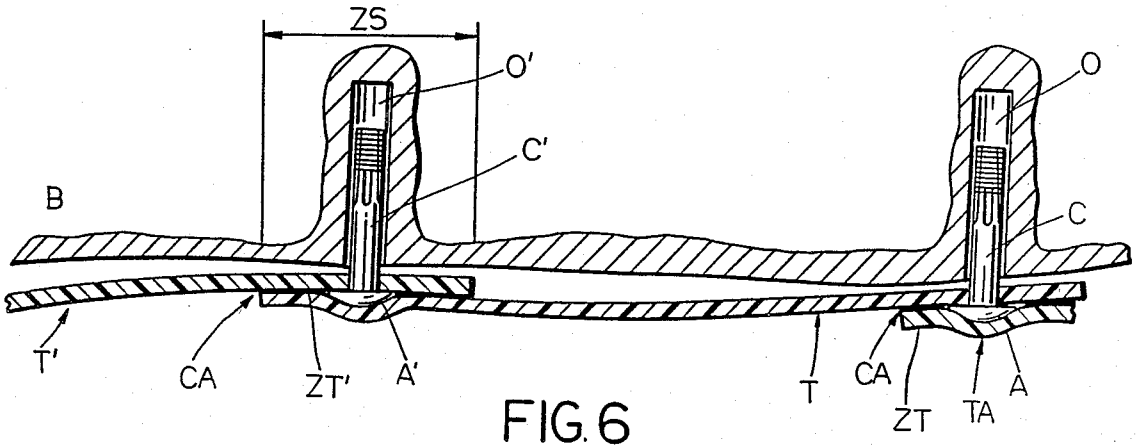
FIG. 6 shows diagrammatically a waterproofed region which comprises two anchors, there being indicated a place of overlap and an intermediate anchor.

FIG. 6 shows the location of an anchor in the overlap zone (ZS) between the sheets T and T'. On the left there can be seen the arrangement of the sheet T' on the surface B.

The anchor C' passes through the sheet T' and penetrates into the hole O'. The head A' of the anchor C' is covered by the overlap sections ZS of the second sheet T. A thermal fusion operation CA produces a zone ZT' around the head A' which results in an absolutely hermetic closure around the head A'.

On the right an anchor C is located within the hole 0 at a place intermediate in the width of the sheet T. The provision of a protective part TA which is heat sealed in the zone ZT around the head A should be noted.

Figure 7:
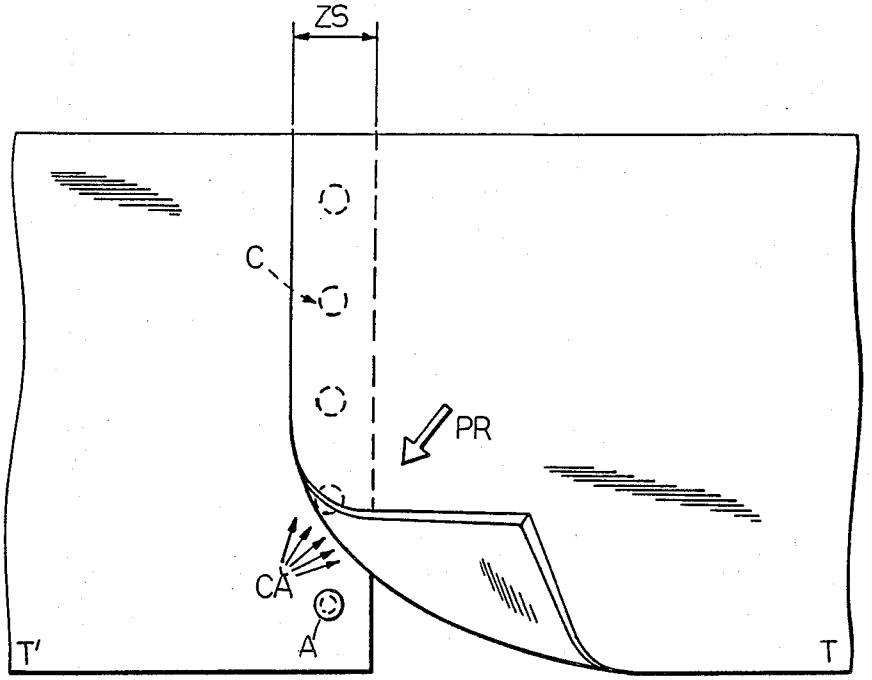
FIG. 7 shows, also diagrammatically, the operation of heat sealing in the region of an overlap of sheets.

FIG. 7 shows how the thermal-fusion welding operation CA is carried out in the overlap zone ZS of the sheets T and T'.

The thermal-welding apparatus applies the heat CA to the entire zone to be sealed, while at the same time a pressure PR is exerted covering the head A of the anchor C which was previously placed through the sheet T'.

Figure 8:
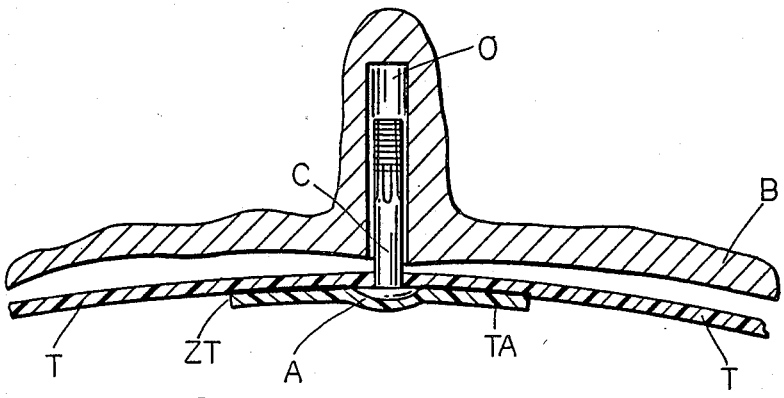
FIG. 8 shows, also diagrammatically, the location of an anchor with protection part.

FIG. 8 shows, in still greater detail than in the left part of FIG. 6, the protective part TA which completely hermetically encloses in the heat-fused zone ZT the head A of the anchor C which passes through the sheet T and penetrates into the hole 0 which has been made through the surface B.

Figure 9:
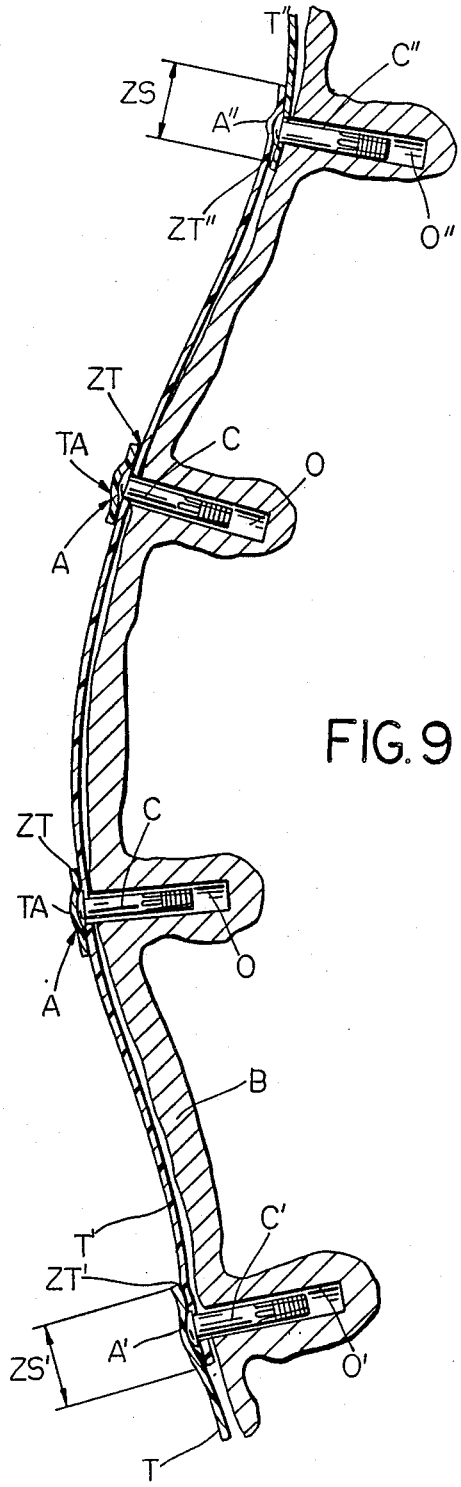
FIG. 9 shows diagrammatically a vertical facing section of a tunnel which shows the attachment of a width of sheet to an irregular, deformed wall, and FIG. 10 finally, shows, also diagrammatically, a region in which there is a protruding element, there being shown the protection thereof by a part in the manner of a washer and a sealer.

In FIG. 9 it can be seen how a width of sheet T' is fitted to a very deformed surface B of a vertical tunnel face, two anchors C in the intermediate zone being protected by the respective protective parts TA, establishing a thermally fused zone ZT around the respective heads A of the anchors introduced into the holes 0.

In the upper and lower parts of the figure two overlap zones ZS' and ZS'' are shown between sheets T-T' and T'-T'', respectively, having thermally fused zones ZT' and ZT'' which protect the heads A' and A'' of anchors C' and C'' which enter into the holes O' and O'', respectively, made in the rock through the surface B.

Figure 10:
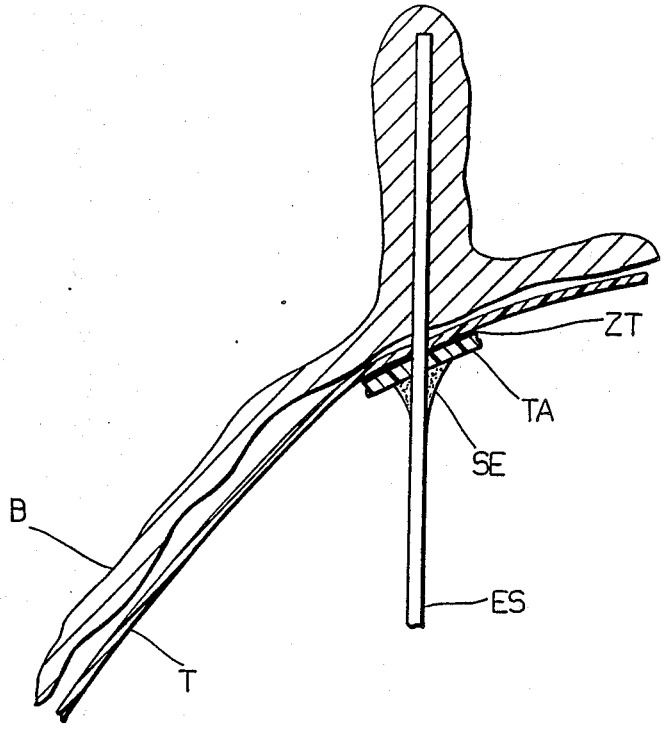

Finally, FIG. 10 shows the case in which it is necessary to fasten to the surface B the support ES of a protruding element, which may be a blower, a light fixture, a carbon-monoxide or hygrometric control device, a strain meter, cable conduits, catenaries and other similar elements. In this case, the support ES, after it has passed through the sheet T and the surface B, is hermetically enclosed by a protective part TA having the shape of a washer, with a diameter which is 6 cm greater than that of the support ES. This protective part TA, which is made of the same material as the sheet T, is thermally welded to it, leaving a zone ZT of equal area to the part TA of washer shape. In order to increase the hermetic closure, a final closure joint (SE) of a sealing material which is compatible with and adapted to the material of said support (which may be aluminum, plastic, iron, etc.) is applied over the outer surface of the part TA facing the inside of the tunnel.

It is necessary to consider the practical reality which requires that, both in the case of tunnels of new construction and in the case of a tunnel which has already been constructed, that it is not possible to start or initiate a waterproofing operation over its entire width because of previously placed scaffoldings or frames necessary for access by personnel to high or upper surfaces at levels of difficult direct access for the mounting of the water-proofing sheets. It is not feasible to prevent or interrupt the passage and access of construction elements and vehicles which are indispensable for production by other work units in the total construction and the completion of the tunnel. It is less feasible to completely interrupt the travel of vehicles in those tunnels which have already been built and are in operation. Therefore, waterproofing system is installed by specific zones of half the available width and furthermore by successive sections in the penetration of the tunnel.

In particular, the sheet material which has been found optimum in the case of our invention is that known under the trademark Ethafoam (R)XL, manufactured by DOW CHEMICAL and which consists of a resilient laminar material of chemically cross-linked polyethylene foam of a closed-cell structure, thus producing impermeability throughout. This material ideally combines the properties and functions of waterproofing, thermal insulation, high resistance to the passage of vapor and of being self-extinguishable or of low inflammability, not producing toxic fumes upon burning, being inalterable with regard to its physical and chemical properties within a temperature range of between 60° C. and 120° C. and being inert at normal temperatures to most chemical agents such as most solvents and all products derived from oil and exhausts, as well as continuous emissions of fumes coming from the vehicles which pass through the tunnels.

Optimally this sheet is reinforced on its two faces with a film of polyethylene and/or raffia.

The significant characteristic properties of the laminar material Ethafoam XL are set forth in tabular form below:

| Property | Test Method Test | Unit | Ethafoam XL 3010Z + film + raffia |
|---|---|---|---|
| Density | DIN 53420 | $kg/m^3$ | 38 |
| Tensile strength | | | |
| longitudinal | ISO 1798 | $kg/cm^2$ | 70.2 |
| transverse | | $kg/cm^2$ | 62.8 |
| Elongation upon rupture | ISO 1798 | % | |
| longitudinal | | % | 100 |
| transverse | | | 105 |
| Thermal conductivity | ASTMC-177 | W/mk | 0.031 |
| Thermal resistance | ASTMC-177 | m2k/w | 0.26 |
| Absorption of water upon 28 days immersion | DIN 53428 | Vol % | 0.8 |
| Rate of transmission of water vapor | ISO 1663 | $g/m^2$ | 23 |
| Permeability | ISO 1663 | $ng/(Pas\ m^2)$ | 10 |

Ethafoam XL comes on rolls of a length of 50 m and a width of 1.5 m, with thicknesses of 6 to 20 mm. Greater thicknesses can be obtained for special cases.

EFFECT OF CHEMICAL AGENTS

| Chemical Agent | Chemical Degradation | Change in Dimensions (%) Length | Width | Thickness | Absorption by wt % | Change in wt % |
|---|---|---|---|---|---|---|
| $SO_4H_2$ (30%) | None | 0.31 | 0.80 | 2.28 | 2.81 | 3.62 |
| $SO_4H_2$ (3%) | None | 0.23 | 0.45 | 2.31 | 1.61 | 1.60 |
| NaOH (10%) | None | 0.29 | 0.59 | 1.37 | 4.01 | 3.10 |
| NaOH (1%) | None | 0.60 | −0.26 | 0.46 | 2.36 | 0.06 |
| $C_2H_5OH$ (95%) | None | 0.22 | −0.65 | 0.00 | 2.43 | −0.92 |
| $C_2H_5OH$ (50%) | None | −0.47 | 0.13 | −0.41 | 15.5 | −0.01 |
| $(CH_3)_2CO$ | None | 0.04 | 0.31 | 0.27 | 22.0 | 0.04 |
| $CH_3CCOOC_2H_5$ | None | 0.43 | 1.33 | 0.53 | 32.7 | 0.30 |
| $CCl_4$ | None | 6.60 | 5.88 | 2.46 | 152 | 0.27 |
| $C_6H_5CH_3$ | None | 4.50 | 2.97 | 1.33 | 115.2 | 0.42 |
| $C_7H_{16}$ | None | 6.67 | 4.04 | 3.30 | 95.0 | 0.34 |
| ClNa(10%) | None | 0.23 | 0.52 | 0.20 | 2.31 | 0.02 |
| $C_6H_5OH$ (10%) | None | 0.41 | 0.91 | 0.41 | 28.1 | 7.06 |
| $H_2O$ | None | 0.61 | −0.11 | 0.21 | 15.5 | −0.01 |
| $NO_3H$ (10%) | None | 0.10 | 0.64 | 0.22 | 3.20 | 0.07 |
| ClH (10%) | None | 0.14 | 0.55 | 0.44 | 4.41 | 0.04 |
| $CH_3COOH$ | None | 0.23 | 0.38 | 0.88 | 7.72 | 0.00 |
| $C_{17}H_{33}COOH$ | None | 1.90 | 1.59 | 0.22 | 29.2 | 21.2 |
| $NH_4OH$ (10%) | None | −0.02 | 0.98 | 0.00 | 7.07 | 0.09 |
| $CO_3Na_2$ (2%) | None | −0.35 | −0.67 | −0.44 | 3.95 | −0.07 |
| $H_2O_2$ | 0.23 | −0.23 | | 0.00 | 7.95 | 0.32 |
| $CH_2COOH$ \| $C(OH)COOH$ \| $CH_2COOH$ | None | −0.71 | −0.44 | −0.67 | 3.64 | −0.11 |
| Gasoline | None | 8.7 | 5.4 | 2.0 | 200 | — |
| Lubricating oil | None | 1.5 | −0.3 | −2.0 | 10.8 | — |

I claim:

1. A method of waterproofing surfaces, in particular inner surfaces of tunnels, channels and mine galleries, said surfaces having irregular walls which may be subjected to strong runoffs, low temperatures, strong and turbulent air flows, in which sheets of material are unrolled from rolls in situ and applied to said walls, said material having the properties of being impermeable to water, flexible and heat weldable, having high resistance to tension, shearing and tearing, being fire resistant self-extinguishable and not giving off toxic fumes, and being resistant and inert to chemical and biological agents and to aging, the method comprising the steps of:

(a) cutting the sheets in situ to the proper lengths in order to perfectly fit the surfaces (B) to be waterproofed;

(b) applying the sheets to said surfaces to produce said fit and to produce overlaps between sheets;

(c) producing in a single operation by a percussion and rotation hole-cutting tool, holes (O) in the rock through the corresponding sheet T and the surface (B);

(d) applying anchors (C) of stainless material and having a head (A), the places of attachment of the anchors (C) being distributed to secure and fix the fit of the respective sheet (T) to the surface (B), heads (A) of the anchors (C') at said overlaps remaining on top of one of the sheets (T') and being covered by the other sheet (T);

(e) welding the overlapping regions (ZS) by thermal fusion (CA), zones of thermal fusion (ZT) remaining around the heads;

(f) applying a circular protective part (TA) of the same material as said sheets, on the anchors of the sheet (T, T') which are not located at said overlaps, the diameter of said part being more than 6 cm greater than the diameter of the heads of said anchors (A);

(g) applying a greater density of anchors in the waterproofing starting and ending zones (AT and ET), and applying a sealing bead between the sheet (T) and the surface (B); and (h) applying in the regions in which elements (ES) protrude from the surface (B) and the sheets (T), protective parts in the form of a washer made of the same material as the sheets and welding said protective parts to the sheet (T) by thermal fusion, leaving a zone (ZT) around the element (ES), and applying a thermally hardenable or vulcanizable sealing material (SE) in rubberoid state to the part (ZT) and around the element (ES).

2. The method according to claim 1, wherein the sheet material (T) is a chemically cross-linked foamed, closed-cell polyethylene of a thickness of between 6 and 60 mm covered on at least one face by a film.

3. The method according to claim 2, wherein said film is chosen from the group comprising polyethylene and raffia.

4. The method according to claim 1, wherein the anchor (C) has the shape of a bolt or dowel of rust-proof material of high density having straited cylindrical body of a diameter slightly greater than that of the hole (O), to be applied by simple impact for being very resistant mechanically to torsion, traction, shear and compression and having great longevity; and a circular head (A).

5. The method according to claim 1, wherein upon the placing of the first and last sheets (AT, ET) of a water-proofing system (CL) are placed closer to each other at the beginning of the first sheet (AT) and at the end of the last sheet (ET) without thermally fused protective parts.

6. The method according to claim 4, comprising sealing the beginning of the first sheet (AT) and the end of the last sheet (ET) with a sealing bead of fireproof, flexible, tear-resistant foamed material having great longevity against permanent humidity and being non-deformable by extreme climatological changes, said bead having a minimum width of 10 cm and thickness of more than 1 cm.

7. The method according to claim 4, comprising sealing the beginning of the first sheet (AT) and the end of the last sheet (ET) with a sealing bead of a hardenable or vulcanizing sealing material in a rubberoid state.

8. A method according to claim 1 further comprising producing a double overlap, both transverse (ST) and longitudinal (SL), of said sheets in a key zone (ZC) of the tunnel, particularly in its vault or roof.

* * * * *

UNITED STATES PATENT AND TRADEMARK OFFICE

CERTIFICATE OF CORRECTION

PATENT NO. : 4,915,542

DATED : April 10, 1990

INVENTOR(S) : Fernando GORDUN BURILLO

It is certified that error appears in the above-identified patent and that said Letters Patent is hereby corrected as shown below:

Title page, item 76 "Gordun B. Fernando" should read -- Fernando Gordun Burillo --.

Signed and Sealed this

Seventeenth Day of March, 1992

*Attest:*

HARRY F. MANBECK, JR.

*Attesting Officer*

*Commissioner of Patents and Trademarks*